US008858225B2

(12) United States Patent
Hiraga

(10) Patent No.: US 8,858,225 B2
(45) Date of Patent: Oct. 14, 2014

(54) COMBUSTION DEVICE

(75) Inventor: Tadayuki Hiraga, Nagoya (JP)

(73) Assignee: Rinnai Corporation, Aichi (JP)

( * ) Notice: Subject to any disclaimer, the term of this patent is extended or adjusted under 35 U.S.C. 154(b) by 296 days.

(21) Appl. No.: 13/411,806

(22) Filed: Mar. 5, 2012

(65) Prior Publication Data

US 2012/0231404 A1 Sep. 13, 2012

(30) Foreign Application Priority Data

Mar. 11, 2011 (JP) ..... 2011-053817

(51) Int. Cl.

| | |
|---|---|
| ***F23D 14/62*** | (2006.01) |
| ***F23D 14/58*** | (2006.01) |
| ***F23D 14/08*** | (2006.01) |
| ***F23D 23/00*** | (2006.01) |
| ***F23D 14/04*** | (2006.01) |

(52) U.S. Cl.

CPC ..... *F23D 14/045* (2013.01); *F23D 14/583* (2013.01); *F23D 14/08* (2013.01); *F23D 23/00* (2013.01)

USPC ..... 431/354; 431/286; 431/349; 29/890.02

(58) Field of Classification Search

CPC ..... F23D 2900/00011; F23D 14/045; F23D 14/583; F23D 14/08; F23D 14/02; F23D 14/62; F23D 14/22; F23D 14/84; F23D 23/00; Y02E 20/344

USPC ..... 431/354, 114, 286, 346, 349, 8, 12; 239/558; 126/39 E; 29/890.02

See application file for complete search history.

(56) References Cited

U.S. PATENT DOCUMENTS

| | | | | |
|---|---|---|---|---|
| 3,198,238 | A | 8/1965 | Hughes | |
| 5,186,620 | A * | 2/1993 | Hollingshead | 431/354 |
| 5,445,519 | A * | 8/1995 | Sigler | 431/286 |

FOREIGN PATENT DOCUMENTS

| | | |
|---|---|---|
| JP | 5-71628 U | 9/1993 |

OTHER PUBLICATIONS

Office Action from Japanese Patent App. No. 2011-053817 (Mar. 5, 2013).

* cited by examiner

*Primary Examiner* — Kenneth Rinehart
*Assistant Examiner* — Bao D Nguyen
(74) *Attorney, Agent, or Firm* — Cermak Nakajim McGowan LLP; Tomoko Nakajima

(57) ABSTRACT

A combustion device has tubular burners with mixing tubes made by joining together two plate members which have formed therein half-split mixing tubes at a distance from one another and which, when joined together, form a clearance serving as a carryover flame hole to communicate a mixing tube with an adjoining mixing tube. An intermediate flame hole portion is formed by recessing backward the front end of the carryover flame hole. A cover portion is formed in each of the two plate members so as to lie opposite to each other with a recessed space lying therebetween. The recessed space is defined as a space that is generated between the intermediate flame hole portion and a line that is drawn in front of the intermediate flame hole portion along the same longitudinal direction as the front end, except for the part of the intermediate flame hole portion.

2 Claims, 3 Drawing Sheets

COMBUSTION DEVICE

This application claims priority under 35 U.S.C. §119 to Japanese Patent Application No. 2011-053817, filed Mar. 11, 2011, which is incorporated by reference.

BACKGROUND

1. Field of the Invention

The present invention relates to a combustion device which is made up of a plurality of tubular burners disposed side by side with one another. Each of the tubular burners includes: a mixing tube with an inlet port at a rear end thereof into which inlet port air-gas mixture of a fuel gas and primary air flows; and a flame hole member which has a plurality of flame holes and which is adapted to be fitted into a front end portion of the mixing tube such that the air-gas mixture is ejected forward through the flame holes so as to perform combustion.

2. Description of the Related Art

As this kind of combustion device, there is conventionally known one which is described in U.S. Pat. No. 5,186,620. In this conventional combustion device, a plurality of mixing tubes of a plurality of tubular burners disposed in parallel (or side by side) with one another are manufactured by combining together two plate members having formed therein a plurality of half-split shape of mixing tubes at a distance from one another. Accordingly, a clearance is formed between front end portions of the two plate members so as to communicate a mixing tube with an adjoining mixing tube. The above-mentioned clearance constitutes a carryover flame hole which is rectangle in shape and through which the air-gas mixture is ejected forward.

By the way, in such a portion of the carryover flame hole as is close to each of the mixing tubes, the air-gas mixture from each of the mixing tubes will be ejected sufficiently. However, in an intermediate portion of the carryover flame hole as seen in a lengthwise direction of the carryover flame hole (in a direction in which the tubular burners are disposed in a side-by-side relationship), the air-gas mixture from each of the mixing tubes becomes hardly ejected, thereby deteriorating the carryover performance. As a solution, in the above-mentioned conventional example, in an intermediate portion as seen in the lengthwise direction of the carryover flame hole, there is provided an intermediate flame hole which recedes further backward from the front end of the remaining portions of the carryover flame hole.

In the above-mentioned conventional example, the front end of each of the plate members is provided with a notched portion which recedes backward, thereby constituting an intermediate flame hole. As a result, the air-gas mixture becomes easier to be ejected out of the intermediate flame hole. However, not only is the air-gas mixture ejected forward out of the intermediate flame hole, but also is the air-gas mixture diffused in a direction of the normal to the plate member through the notched portions. As a result, the amount of such ejected gas in the forward direction as is required for the carrying over of the flame decreases, whereby sufficient carrying over performance cannot be obtained.

SUMMARY

Problems to be Solved by the Invention

In view of the above points, this invention has a problem of providing a combustion device which solves the problem of shortage in the amount of gas to be ejected forward at an intermediate portion as seen in the longitudinal direction of the carryover flame hole, whereby the carryover performance can be improved.

Means for Solving the Problems

In order to solve the above-mentioned problems, this invention provides a combustion device comprising a plurality of tubular burners disposed side by side with one another. Each of the tubular burners includes: a mixing tube with an inlet port at a rear end thereof into which air-gas mixture of a fuel gas and primary air flow; and a flame hole member which has a plurality of flame holes and which is adapted to be fitted into a front end region of the mixing tube such that air-gas mixture is ejected forward through the flame holes to perform combustion. The plurality of mixing tubes of the tubular burners are constituted by joining together two plate members, each having a plurality of half-split mixing tubes formed therein at a distance from one another. The two plate members have a clearance that is formed between front end portions of each of the two plate members so as to communicate a mixing tube with an adjoining mixing tube such that the clearance constitutes: a carryover flame hole of rectangular shape for ejecting forward the air-gas mixture; and an intermediate flame hole portion which is recessed backward from the front end of remaining portions of the carryover flame hole. A cover portion is formed in each of the two plate members so as to lie opposite to each other with a recessed space lying therebetween, provided that the recessed space is defined as a space that is generated between the intermediate flame hole portion and a line that is drawn in front of the intermediate flame hole portion along the same longitudinal (i.e., backward and forward) direction as the front end, except for the part of the intermediate flame hole portion, of the carryover flame hole. The clearance between the cover portions is larger in width than the width of the carryover flame hole.

According to this invention, the cover portion can prevent the air-gas mixture from getting diffused in a direction of the normal to the plate members, the air-gas mixture being ejected from the intermediate flame hole portion that is located at the laterally intermediate portion of the carryover flame hole. As a result, the air-gas mixture to be ejected from the intermediate flame hole portion is all ejected forward through the recessed space. Therefore, the amount of the ejected gas in the forward direction from the laterally intermediate portion of the carryover flame hole increases as compared with the amount in the conventional example, thereby improving the carryover performance. It is to be noted that, since the clearance between the cover portions is larger in width than the clearance at the carryover flame hole, there is no possibility that the amount of ejected gas decreases due to the flow resistance between the cover portions.

It is conceivable to notch the portions that lie opposite to the recessed space of the two plate members. By subsequently providing the outer surfaces of the two plate members with other plates that serve to cover the notch, the cover portions are formed. However, this arrangement will result in an increase in the number of constituting parts and an increase in cost.

As a solution, according to this invention, the cover portions are preferably constituted by denting (or recessing) the two plate members in a direction away from each other, instead of notching such portions of the two plate members as are lying opposite to the recessed space. According to this arrangement, the cover members are integrally formed with the plate members, whereby the increase in cost due to an increase in the number of the constituting parts can be avoided.

DETAILED DESCRIPTION OF PREFERRED EMBODIMENTS

Figure 1:
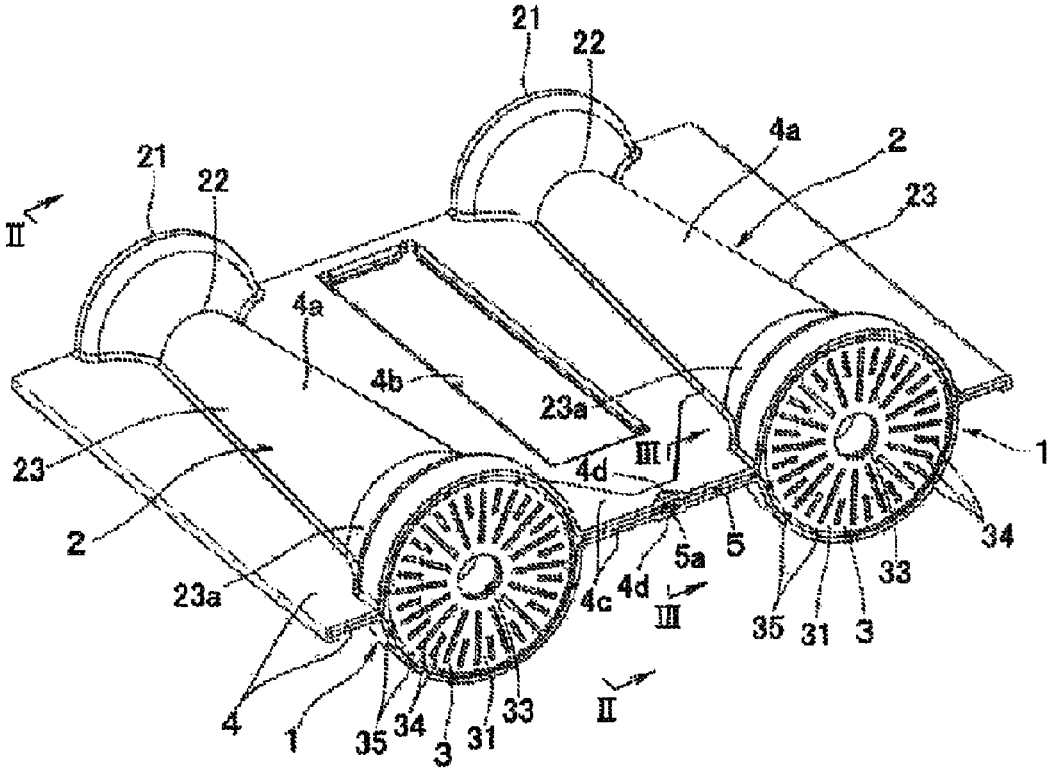
FIG. 1 is a perspective view of a combustion device according to this invention.
Figure 2:
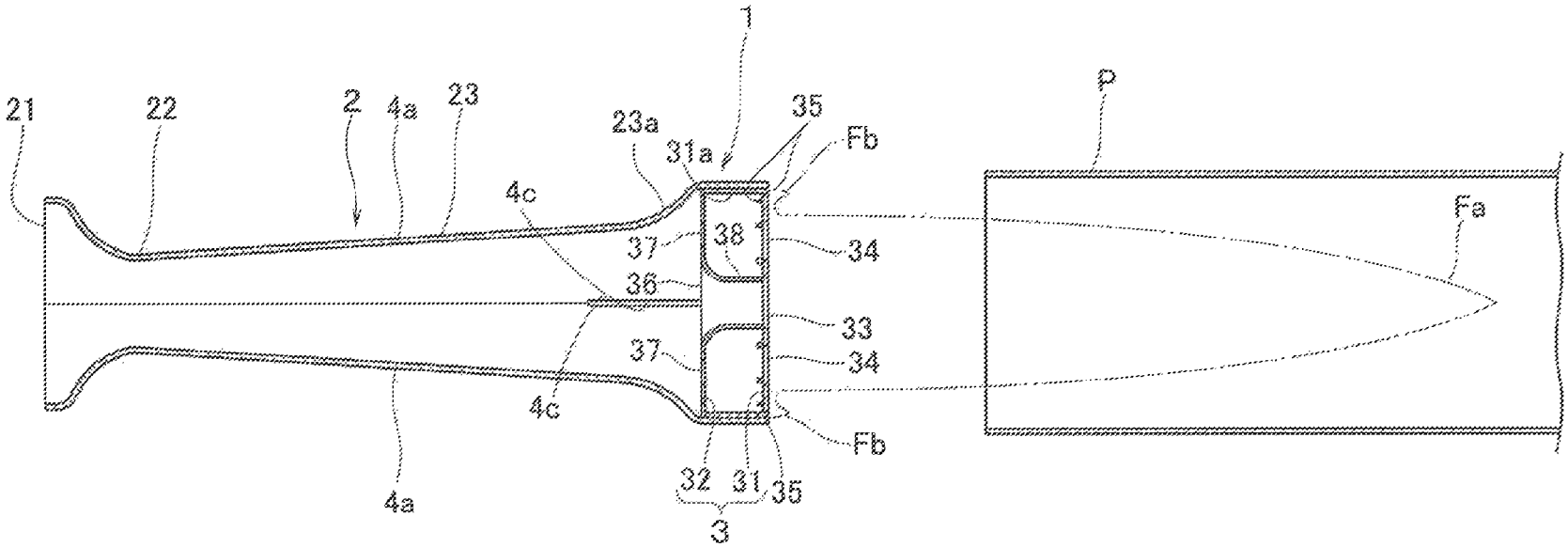
FIG. 2 is a sectional view taken along line II-II in FIG. 1.

With reference to FIG. 1 the combustion device in one embodiment of this invention is constituted by disposing two tubular burners 1 in parallel (or side by side) with each other. This combustion device is used as a heat source of a heater. As shown in FIG. 2, an inlet end of each heat exchange pipe P is disposed so as to lie opposite to the front of each of the tubular burners 1.

The tubular burner 1 is made up of a mixing tube 2 which is elongated in the backward and forward (i.e., longitudinal) direction, and a flame hole member 3 which is adapted to be fitted into a front end region of the mixing tube 2. The mixing tube 2 has: an inlet port 21 at a rear end of the mixing tube 2; a venturi section 22 which is reduced in diameter relative to the inlet port 21; and a tapered tube section 23 which is gradually increased in diameter from the venturi section 22 forward. In this arrangement, a fuel gas ejected from a gas nozzle (not illustrated) which is disposed so as to face the inlet port 21, and primary air flow from the inlet port 21 into the mixing tube 2 so that air-gas mixture of the fuel gas and primary air is generated within the mixing tube 2.

The front end region of the mixing tube 2 is formed into a cylindrical shape which is elongated forward from an enlarged-diameter region 23*a* of a curved shape at the front end of the tapered tube section 23. The flame hole member 3 to be fitted into the front end region of the mixing tube 2 is constituted by a front plate 31 and a disk shaped rear plate 32 which is located backward of the front plate 31.

The front plate 31 has a tubular member 31*a* which is elongated backward from a circular disk-shaped front portion adapted to be fitted into the inner circumference of the front end region of the mixing tube 2. The front plate 31 is provided with a first flame hole 33 in the central portion at the front face of the front plate 31, and a plurality of second flame holes 34 which are located around the periphery of the first flame hole 33 and which are in the shape of a slit having a width (e.g., 0.7 mm) below a quenching distance. In addition, at the front end rounded corner portion of the tubular member 31*a*, there are formed a plurality of flame retention holes 35 of a slit shape at a circumferential distance from one another.

The rear plate 32 is provided with a first ventilation hole 36 in the central portion of the rear plate 32, and a plurality of second ventilation holes 37 which are of a smaller diameter than that of the first ventilation hole 36 and which are located around the periphery of the first ventilation hole 36. The rear plate 32 has further formed therein a cylindrical section 38 which projects forward to the first flame hole 33 from the hole edge of the first ventilation hole 36. It is thus so arranged that the air-gas mixture flowing into the first ventilation hole 36 is introduced into the first flame hole 33 through the cylindrical section 38.

According to this arrangement, the flow of the air-gas mixture directed to the first flame hole 33 is rectified by the cylindrical section 38. As a result, the air-gas mixture is forcibly ejected forward from the first flame hole 33. On the other hand, the flow velocity of the air-gas mixture to be ejected from the slit-shaped second flame holes 34 in the front plate 31 through the second ventilation holes 37 of relatively smaller diameter in the rear plate 32 is kept relatively low. As a result, due to Bernoulli law, the air-gas mixture ejected from the second flame holes 34 is attracted by the flow of the air-gas mixture ejected at a high speed from the first flame hole 33. Consequently, the flames to be formed by the combustion of the air-fuel mixture ejected from the second flame holes 34 are combined or integrated into the flame to be formed by the combustion of the air-fuel mixture ejected from the first flame hole 33, whereby aggregated flames Fa elongated forward as shown in FIG. 2 are formed, and the flames can surely be fed into the heat exchange pipe P. In addition, due to the combustion of the air-gas mixture to be ejected at a low velocity from the flame retention holes 35, there can be formed small flames Fb that are hard to be lifted, thereby securing flame stabilizing property.

Two mixing tubes 2, 2 of two tubular burners 1, 1 constituting the combustion device are made by joining (or coupling) two plate members 4, 4 which are formed by laying out therein two half-split sections 4*a* of the mixing tubes 2 which are disposed at a lateral distance therebetween in a side-by-side (sidewise) positional relationship. At a laterally middle position of both the plate members 4, 4, there is formed an opening 4*b*. An edge portion at the opening 4*b* of the upper plate member 4 is hemmed so as to get overlapped with the lower surface of the edge portion at the opening of the lower plate member 4. Also the side peripheral portions of laterally both sides of the upper plate member 4 are hemmed so as to get overlapped with the lower surfaces of the side edge portions of the lower plate member 4. Both the plate members 4, 4 are thus connected together.

At a front end of that portion of both the plate members 4, 4 which is positioned between both the mixing pipes 2, 2, there are formed dented portions 4*c*, 4*c* which are dented in a direction in which both the plate members 4, 4 are away from each other. Between the dented portions 4*c*, 4*c* there is defined a clearance that communicates both the mixing pipes 2, 2. That side portion of each of the dented portions 4*c* which is closer to the mixing pipes 2 is more elongated backward than is the case with the intermediate portion thereof so as to reach the tapered tube section 23 that is backward of the front end of each of the mixing tubes 2 into which the flame hole member 3 is fitted. Therefore, the air-gas mixture will be branched to flow from the tapered tube section 23 of each of the mixing tubes 2 into the clearance between the dented portions 4*c*, 4*c*. Due to this clearance, there is constituted a carryover flame hole 5 of rectangular shape between the front ends of both the mixing tubes 2, 2 so that the air-gas mixture can be ejected forward through this clearance, whereby flame carryover will be performed between both the tubular burners 1, 1.

By the way, in that portion of the carryover flame hole 5 which is near each of the mixing tubes 2, the air-gas mixture will be sufficiently ejected from each of the mixing tubes 2. In the laterally (or sidewise) intermediate portion of the carryover flame hole 5, however, the air-gas mixture from each of the mixing tubes 2 will hardly be ejected, whereby flame carryover performance become deteriorated.

Figure 3A:
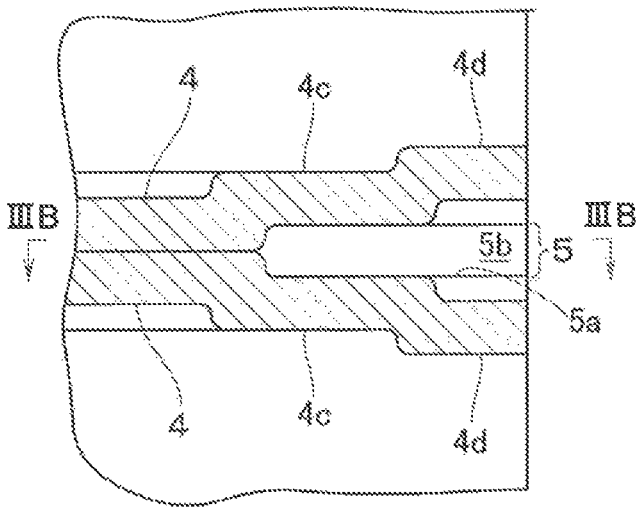
FIG. 3A is an enlarged sectional view taken along line III-III in FIG. 1
Figure 3B:
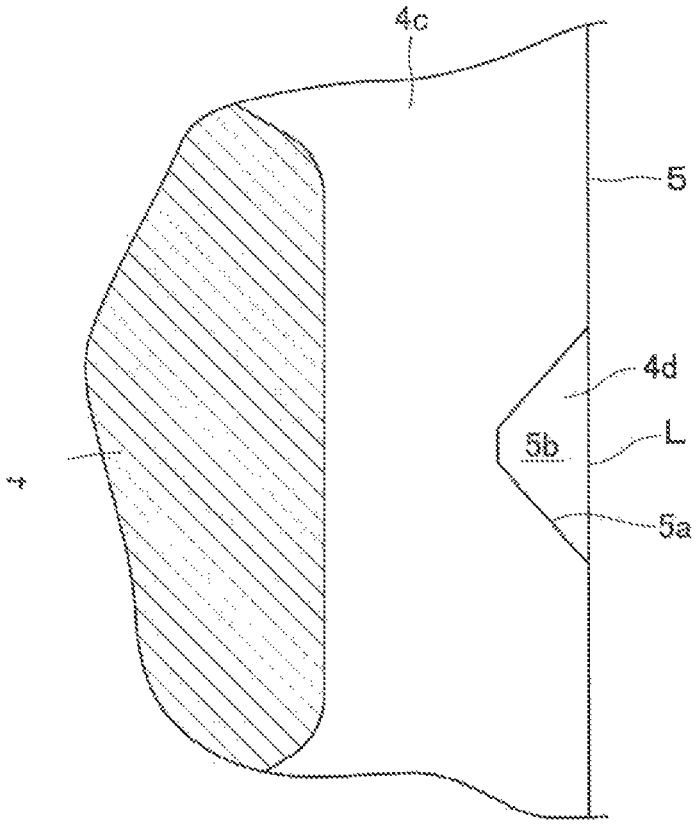
FIG. 3B is a sectional plan view taken along line IIIB-IIIB in FIG. 3A.

As a solution, in this embodiment, the following arrangement has been employed as shown in FIGS. 1 and 3, in order to facilitate the ejection of the air-gas mixture from each of the mixing tubes 2. In other words, in an intermediate portion as seen in the lateral or sidewise direction of the flame carryover port 5, there is formed an intermediate flame hole portion 5*a* of V-shape which is recessed backward from the front end of the remaining portions of the carryover flame hole 5. In this embodiment the portion to dispose the intermediate carryover flame hole 5*a* is limited to only one place in the laterally central portion of the carryover flame hole 5. However, it is possible to dispose the intermediate flame hole portion in a plurality of places of the lengthwise intermediate portion of the carryover flame hole 5.

Still furthermore, in this embodiment, suppose that a space to be generated between a line L and the intermediate flame hole portion 5*a* is defined as a recessed space 5*b*, where the line L is drawn in front of the intermediate flame hole portion 5*a* at the same position in the back-and-forth direction as the front end, except for the intermediate flame hole portion 5*a*, of the carryover flame hole 5. Then, cover portions 4*d*, 4*d* are formed in both the two plate members 4, 4 so as to lie opposite to each other with the recessed space 5*b* lying therebetween. In addition, the clearance between the cover portions 4*d*, 4*d* is arranged to be larger in width than the width of the carryover flame hole 5. Specifically, the width of the clearance of the carryover flame hole 5 and the width of the clearance between the cover portions 4*d*, 4*d* are set to be, e.g., 0.8 mm and 1.5 mm, respectively.

According to this arrangement, the air-gas mixture ejected from the intermediate flame hole 5*a* that is located in the laterally intermediate portion of the carryover flame hole 5 can be prevented by the cover portions 4*d*, 4*d* from getting diffused in the direction of the normal to the plate members 4, 4 (i.e., in the up and down direction). As a result, the air-gas mixture to be ejected from the intermediate flame holes 5*a* can all be ejected in the forward direction through the recessed space 5*b*. Consequently, the amount of gas to be ejected from the laterally intermediate portion of the carryover flame hole 5 can be increased, thereby improving the flame carryover performance. Since the clearance between the cover portions 4*d*, 4*d* is larger than the clearance in the carryover flame hole 5, the amount of ejected gas is not reduced due to the flow resistance through the cover portions 4*d*, 4*d*.

By the way, it is possible to notch (or cut out) the portions that lie opposite to the recessed space 5*b* of the recessed portions 4*c*, 4*c* of both the plate members 4, 4 so that separate plates are attached in a manner to cover the notched portions, thereby constituting the cover portions. This solution will, however, bring about an increase in the number of constituting parts and cost.

As a solution, in this embodiment, an arrangement is made that the cover portions 4*d*, 4*d* are constituted by denting the two plate members 4, 4 in a direction away from each other, instead of notching such portions of the two plate members as are lying opposite to the recessed space 5*b*. According to this arrangement, each of the cover portions 4*d*, 4*d* will be integrally formed in the plate member 4, thereby avoiding an increase in cost due to an increase in the number of constituting parts. The drawing work of the cover portions 4*d*, 4*d* may be performed simultaneously with the drawing work of the half-split portions 4*a* and the recessed portions 4*c*.

A description has so far been made of an embodiment of this invention with reference to the accompanying drawings. This invention shall not be limited to the above. For example, in the above embodiment, the shape of the recessed portion 5*a* of the intermediate flame hole portion 5*a* is arranged to be in the backwardly recessed V-shape. The shape of this recessed portion may alternatively be of U-shape. Further, in the combustion device of the above-mentioned embodiment, two tubular burners 1 are disposed side by side with each other. However, the number of the tubular burners 1 to be disposed in parallel with one another may be 3 or more.

Still furthermore, in the above-mentioned embodiment, the longitudinal direction of the mixing tube 2 is defined as the back-and-forth direction. It is to be noted that the back-and-forth direction is not intended to define the direction in which the combustion device is put to actual use. As the combustion device of this invention, there will therefore be included a combustion device which is used in an upward-looking posture in which the front end of the mixing tube 2 looks upward.

DESCRIPTION OF REFERENCE NUMERALS

| | | | |
|---|---|---|---|
| 1 | tubular burner | 2 | mixing tube |
| 21 | inlet port | 3 | flame hole member |
| 33, 34 | flame hole | 4 | plate member |
| 4a | half-split section of the mixing tube | | |
| 4d | cover portion | 5 | carryover flame hole |
| 5a | intermediate flame hole portion | | |
| 5b | recessed space | | |

What is claimed is:

1. A combustion device comprising:

a plurality of tubular burners disposed side by side with one another, each of the tubular burners including: a mixing tube with an inlet port at a rear end thereof into which air-gas mixture of a fuel gas and primary air flows; and a flame hole member which has a plurality of flame holes and which is adapted to be fitted into a front end region of the mixing tube such that air-gas mixture is ejected forward through the flame holes to thereby perform combustion, the plurality of mixing tubes of the tubular burners being constituted by joining together two plate members having a plurality of half-split mixing tubes formed therein at a first distance from one another, the two plate members having a clearance formed between front end portions of the two plate members so as to communicate a mixing tube with an adjoining mixing tube such that the clearance constitutes:

a carryover flame hole of rectangular shape for ejecting forward the air-gas mixture; and a lengthwise intermediate flame hole portion which is recessed backward from the front end of remaining portions of the carryover flame hole, wherein a cover portion is formed in each of the two plate members so as to lie opposite to each other with a recessed space lying therebetween, provided that the recessed space is defined as a space that is generated between the intermediate flame hole portion and a line that is drawn in front of the intermediate flame hole portion along a same longitudinal direction as the front end, except for the part of the intermediate flame hole portion, of the carryover flame hole, and wherein a second distance between inner surfaces of the cover portions facing each other is larger than a width of the carryover flame hole, and the air-gas mixture ejected forward from the intermediate flame hole portion is guided by the cover portions and in contact with the inner surfaces of the cover portions.

2. The combustion device according to claim 1, wherein the cover portion is constituted by denting the two plate members in a direction away from each other, instead of notching such portions of the two plate members as are lying opposite to the recessed space.

* * * * *